United States Patent [19]

Amoretti

[11] 4,093,139

[45] June 6, 1978

[54] SUPPORT FOR LONG ROLLS OF SHEET MATERIAL

[76] Inventor: Alfred P. Amoretti, 5 ruelle St. Roch, Nice, France

[21] Appl. No.: 756,860

[22] Filed: Jan. 5, 1977

[51] Int. Cl.[2] ..... B65H 75/12

[52] U.S. Cl. ..... 242/55.2; 242/DIG. 3; 242/68.7

[58] Field of Search ..... 242/55, 68.7, 78.7, 242/78.8, 192, DIG. 3; 214/312, 340; 312/37–41

[56] References Cited

U.S. PATENT DOCUMENTS

| | | | |
|---|---|---|---|
| 3,643,885 | 2/1972 | Keesling et al. | 242/55 |
| 3,889,831 | 6/1975 | Davis | 214/340 |
| 3,957,220 | 5/1976 | Beck et al. | 242/68.7 |

FOREIGN PATENT DOCUMENTS

| | | | |
|---|---|---|---|
| 228,151 | 7/1963 | Austria | 242/68.7 |

*Primary Examiner*—Leonard D. Christian

[57] ABSTRACT

Long rolls of sheet material are supported in a cradle comprised by two superposed bands of endless material trained about end rollers. The ends of the rollers are connected to intermediate supports which in turn are bodily oscillable, and perhaps also vertically swinging, within fixed C brackets whose legs are slotted to receive pins or bolts on the intermediate supports. Relative movement and friction between the endless bands and the sheet material being rolled or unrolled, are thus avoided.

8 Claims, 3 Drawing Figures

Fig.1
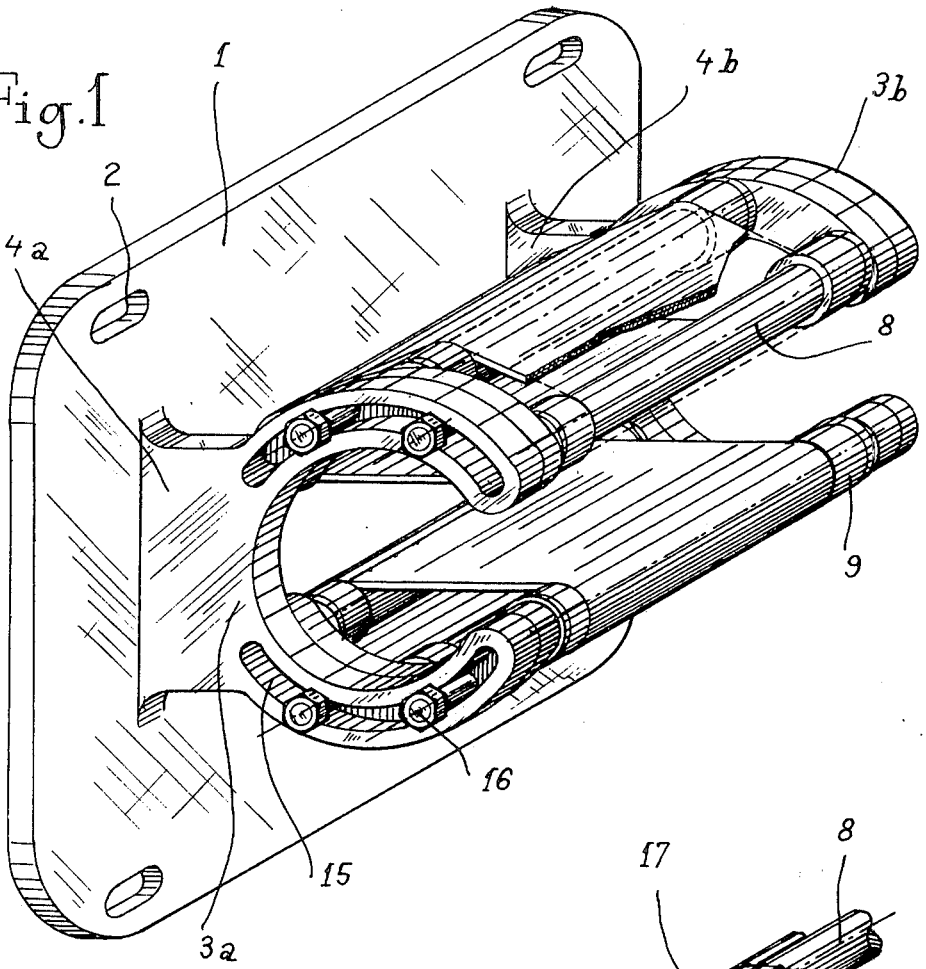
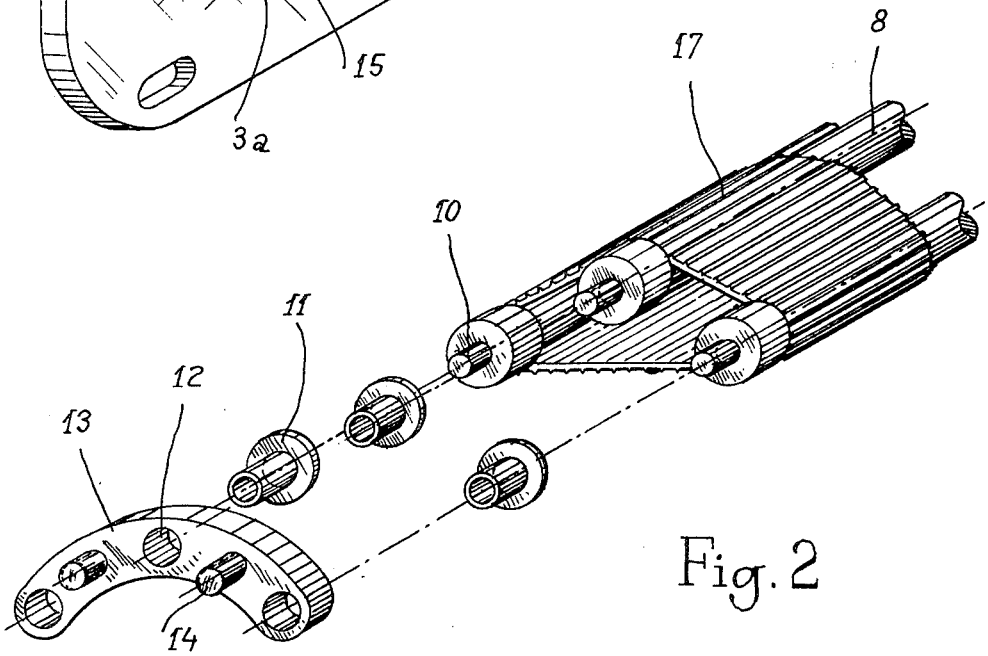
Fig. 2

SUPPORT FOR LONG ROLLS OF SHEET MATERIAL

The present invention relates to winding and unwinding sheet material of indeterminate length, onto and from rolls, particularly rolls having a great length which, for that reason, require an intermediate support so as to prevent the rolls from bending down in the middle.

Stationary and/or rigid supports of this type are already known, constituted by a pair of rings in which the roll of sheet material is received, these rings being broken away at one side to permit the insertion and removal of the roll.

In order to increase the support surface of such devices, it has been proposed to provide the rings with an internal cylindrical skirt of metal or plastic material on which the roll of sheet material rests and slides. However, the friction of the sheet material on the cylindrical skirt, upon winding or unwinding, gives rise to frictional forces which require work to overcome, and also exert some frictional wear on the sheet material and may cause folds to occur in the sheet material. Moreover, the roller on which the material is rolled tends to move downwardly as the material is unrolled and the roll decreases in diameter, so that its guidance is no longer entirely satisfactory. Thus the rigid and static structures heretofore provided for this purpose, have a number of drawbacks.

It has also been proposed to provide pairs of such rings, each pair supporting a series of rollers that are free to turn on their axes, the sheet material being supported on these series of rollers. Such an arrangement can be considered a movable but rigid arrangement and is not entirely satisfactory, because the sheet material tends to sag between the rollers, which gives rise to buckling of the sheet material, which buckling in turn gives rise to folds in the material that can in turn result in wear on the material and/or tearing of the material.

Accordingly, it is an object of the present invention to provide a support for long rolls of sheet material, which overcomes the above disadvantages.

In order to achieve this object, the present invention provides a construction which is both movable and flexible. The device of the present invention is charactezied by two sets of elongated rollers, an upper set and a lower set. Each of the two sets is encompassed by an endless flexible band of elastic material; and the roll of sheet material to be rolled up or unrolled is received between these endless bands and supported therebetween in the manner of a covered cradle.

Thanks to this arrangement, the elastic bands circulate on their respective rollers with the same speed as the tangential speed of rolling or unrolling of the sheet material on or from the roll thereof, with the result that there is little if any relative movement between the bands and the sheet material. The bands thus forming continuous surfaces, and thus being always in contact with the sheet material both above and below the sheet material, there is no occasion for the roll of sheet material to sag or bend in the middle between end supports, because the roll of sheet material in effect is evenly supported along substantially its entire length.

Moreover, the endless bands being driven by the sheet material, there is no sliding friction and the tension in the sheet material and hence the work necessary to roll it up or unroll it, are reduced to a minimum.

Still further, the tension in the elastic bands, which is preferably regulable, automatically ensures a centering of the roll of sheet material no matter how enlarged or diminished the diameter of the roll of sheet material may be.

Finally, by virtue of the nature of the support that is thus provided, it becomes possible greatly to decrease the number of supports for the same extent of bearing surface which it is desired to provide, thereby effecting an economy in construction, installation, operation, maintenance and repair.

Other objects, features and advantages of the present invention will become apparent from a consideration of the following description, taken in connection with the accompanying drawings, in which:

FIG. 1 is a perspective view, with parts broken away, showing a first embodiment of my invention;

FIG. 2 is an exploded fragmentary perspective view of the upper rollers and endless band of the device of FIG. 1.

Figure 3:
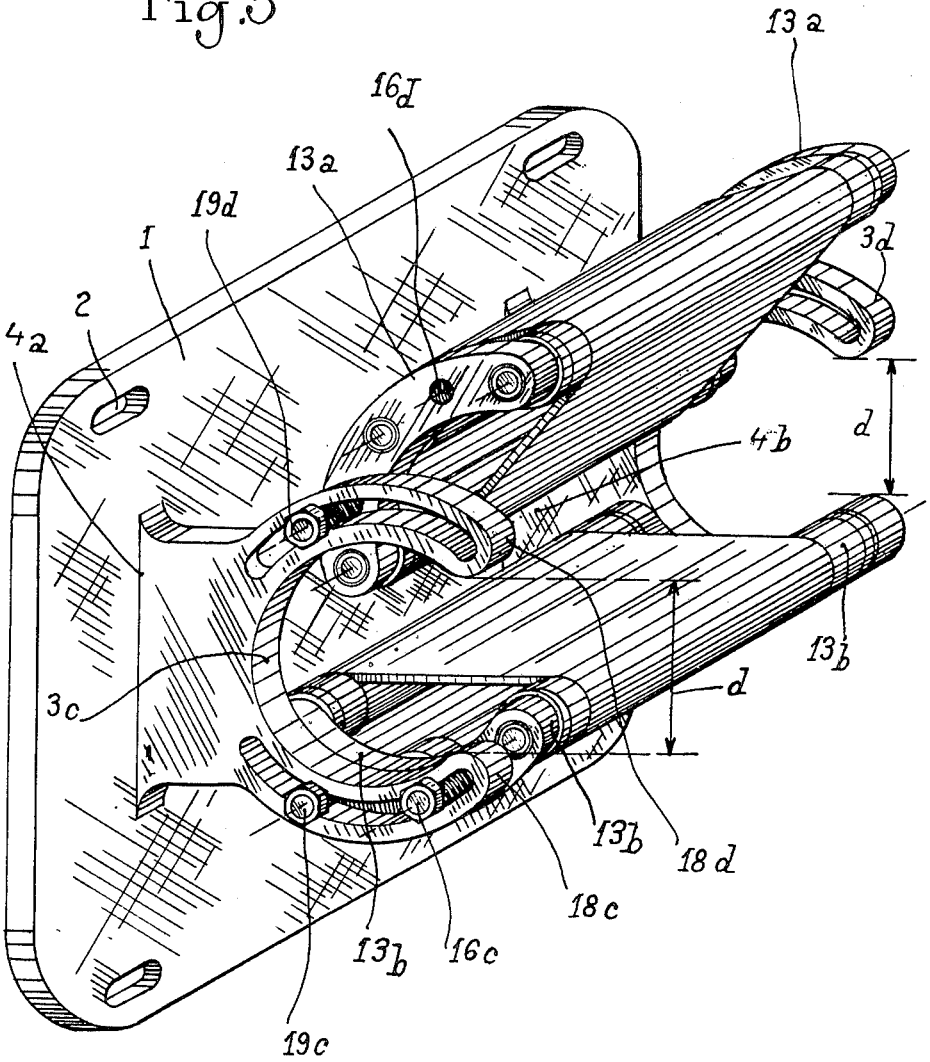
FIG. 3 is a view similar to FIG. 1 but showing a modified form of the invention.

Referring now to the drawings in greater detail, and first to the embodiment of FIGS. 1 and 2, there is shown apparatus according to the present invention, comprising a base 1 adapted to be fixed to a wall by means of screws (not shown) passing through holes such as 2, which are preferably oblong to facilitate adjustment of the position of base 1.

On base 1 are supported, parallel to each other and perpendicular to base 1, two split rings 3*a*, 3*b* having integral therewith plates 4*a* and 4*b* by which they are fixed to base 1.

The roll of sheet material (not shown) is received within these two rings 3*a*, 3*b*, the spool of the roll being of a length greater than the distance between the rings 3*a*, 3*b*, the width of the sheet material on that roll being less than that distance, the diameter of the spool being less than the distance between the legs of each split ring, and the greatest diameter of the sheet material on the spool being greater than that last-named distance.

Between the rings 3*a*, 3*b* are disposed rollers for guiding and supporting the roll of sheet material. In the illustrated example, there is an upper series of rollers 8 and a lower series of rollers 9. The axles 10 of these rollers are received within an auxiliary bushing 11 which forms a rotary bearing therefor, and the roller bushings of each set are received in holes 12 within an intermediate support or connectors 13 (see FIG. 2) in the form of a part cylindrical sector having the same radius of curvature as the legs of the split rings 3*a*, 3*b*. There are intermediate supports 13 at each ends of the rollers 8 and 9, and each support 13 has laterally outwardly extending pins 14 which enter and slide in slots 15 of rings 3*a* and 3*b*. The intermediate supports 13, and hence the entire set of rollers associated therewith, can thus slide bodily in its associated slots 15 in a circular path of a radius substantially greater than the distance between the slot 15 and the axis of the roll of sheet material. The bodily oscillated position of the assembly of intermediate supports 13 and the associated series of rollers 8 or 9, can be selectively locked in any desired position by means of nuts 16 on the outer screwthreaded ends of pins 14. The purpose of this adjustment will be explained hereinafter.

Of course, the structure shown in FIG. 2 is duplicated at the other end of the rollers 8.

An endless band 17 of flexible and elastic material, such as rubber or analogous synthetic material, is disposed about each series of rollers 8 and 9. This endless band constitutes a rolling sleeve or skirt for the sheet material on the roll, which moves with the sheet material as the sheet material is being rolled up on the roll or unrolled from the roll, whereby the sheet material drives these endless bands which thus circulate about and on their respective rollers 8 or 9.

The roll of sheet material is thus in large area contact with the endless surface of the bands 17 and has no direct contact with the rollers 8 and 9, so that it cannot sag in the middle or become folded or bunched between the rollers as happened in the case of the prior art. Moreover, the outer surface of the bands 17 can be provided with grooves or ribs which are transverse, that is, parallel to the axis of the associated rollers, so as to improve the gripping between the roll of material and the bands thereby to ensure against relative slipping.

It should also be noted that, as the sheet material is supported on a surface which always moves in the same direction and at the same speed as the sheet material, the braking effect on the sheet material, always present in the prior art, is minimized. Thus the work necessary to roll up or unroll the sheet material is greatly decreased.

Still further, the tension in the two bands 17 is applied to opposite sides of the rolled up material in such a way as to ensure that the roll of sheet material will tend to remain substantially centered in the device no matter what the diameter of the roll of sheet material.

Still further, the support of the roll of sheet material being thus better provided by the apparatus of the present invention, it becomes possible to reduce the number of such support devices and/or to increase the length of the roll to be supported thereby, without encountering the undesirable features of the prior art recited above, and with consequent economies.

It will also be recognized that an apparatus according to the present invention requires substantially no upkeep.

Finally, the pressure exerted by the elastic bands on the roll of sheet material may be easily adjusted by loosening the nuts 16 and sliding the intermediate supports 13 in the slots 15. This adjustive movement also makes it possible to insert or remove rolls on which the thickness of the sheet material is relatively great.

There is shown in FIG. 3 a modified form of the present invention, which makes it easier to insert the roll of sheet material from the front of the device. In FIGS. 1 and 2, the roll of sheet material was inserted endwise, which has the disadvantage that as the roll of sheet material is sometimes of great length, a rather delicate operation was required to insert the roll.

But in the embodiment of FIG. 3, the legs of the C-shaped split rings 3*c* and 3*d* are shorter than in the embodiment of FIGS. 1 and 2, with the result that a gap *d* is provided which permits forward loading and unloading of the roll of sheet material. The intermediate supports or connectors 13*a*, 13*b*, however, being longer than the legs of the split rings, effectively close the device against forward insertion and removal of the roll when the series of rollers are closed as in the FIG. 1 position.

To permit the insertion or removal of the roll of material, therefore, one or both of the series of rollers 8, 9 is made to swing away from the other.

To this end, the pins 14 of FIG. 2 are replaced by internally screw-threaded boltholes 16*d*, which releasably retain screw-threaded bolts 16*c*, 19*c* and 19*d*, and another one which is not shown because it has been removed in FIG. 3 for purposes of clarity. Of course, the same bolts are provided at the other end of the device of FIG. 3, that is, the end not visible in the drawing.

In this way, when the bolts 16 are removed from either set of rollers, at both ends of the set of rollers, then the associated set of rollers with its associated endless band can be swung up to the FIG. 3 position, thereby to widen the gap and permit the entry or removal of a roll of sheet material.

Of course it is to be understood that not only the upper band, but also the lower band can be swung vertically to widen the gap. Thus, if there is an overhanging obstruction which makes it inconvenient to raise the upper band, then the lower band can be swung down after removal of the bolts 16*c*. Or of course both bands could be swung away from each other.

FIGS. 1 and 3 differ from each other principally, therefore, in that in FIG. 1 the roller sets are bodily slidable about the arcs of the slots 15; while in FIG. 3, the roller sets are both bodily slidable and vertically swinging.

In the claims that follow, the pins 14 and the bolts 16 and 19 will be generically referred to as "pins".

In view of the foregoing disclosure, therefore, it will be evident that all of the initially recited objects of the present invention have been achieved.

Although the present invention has been described and illustrated in connection with preferred embodiments, it is to be understood that modifications and variations may be restored to without departing from the spirit of the invention, as those skilled in this art will readily understand. Such modifications and variations are considered to be within the purview and scope of the present invention as defined by the appended claims.

What is claimed is:

1. A support for a roll of sheet material having a base, comprising an upper series of rollers and a lower series of rollers, an upper endless band of flexible elastic material disposed about said upper rollers, and a lower endless flexible band of elastic material disposed about said lower rollers, said support being adapted to receive a roll of sheet material between said bands with said bands in contact with upper and lower portions of the periphery of the roll, said bands being driven by the roll of sheet material upon rotation of the roll of sheet material.

2. A support as claimed in claim 1, and connectors interconnecting the rollers of each said series as opposite ends of the series, and guide means adjustably supporting said connectors for bodily movement of each series of rollers in an arcuate path.

3. A support as claimed in claim 2, said guide means having arcuate slots therein for the guidance of said connectors.

4. A support as claimed in claim 3, said arcuate slots extending along the length of the arms of a C-shaped bracket comprising said guide means.

5. A support as claimed in claim 1, said endless band having ribs on its surface that contact the roll of sheet material.

6. A support as claimed in claim 1, and means mounting at least one said series of rollers for vertical swinging movement to enlarge a gap through which a said roll of sheet material may be inserted into or removed from the support.

7. A support as claimed in claim 6, said mounting means for said at least one series of rollers comprising pin and slot means whereby pins carried by said series of rollers are received in slots fixed on base for said support, for adjustive bodily movement of said series of rollers by means of sliding movement of said pins in said slots, or vertical swinging movement of said series of rollers about said pins in said slots.

8. A support as claimed in claim 7, said slots being arcuate, there being vertically superposed said slots for said upper and lower series of rollers, said upper slots beng downwardly concave and said lower slots being upwardly concave.

* * * * *